US007004209B2

(12) United States Patent
Davis et al.

(10) Patent No.: US 7,004,209 B2
(45) Date of Patent: Feb. 28, 2006

(54) FLEXIBLE MOUNTING FOR EVACUATION CHANNEL

(75) Inventors: Samuel N. Davis, Dublin, OH (US); James Johnson, Delaware, OH (US); Kevin Bergenthun, Newark, OH (US); Timothy Frazier, Westerville, OH (US)

(73) Assignee: Liqui-Box Canada Inc., Whitby (CA)

( * ) Notice: Subject to any disclaimer, the term of this patent is extended or adjusted under 35 U.S.C. 154(b) by 0 days.

(21) Appl. No.: 10/460,427

(22) Filed: Jun. 10, 2003

(65) Prior Publication Data

US 2004/0123918 A1 Jul. 1, 2004

Related U.S. Application Data

(66) Substitute for application No. 60/386,749, filed on Jun. 10, 2002.

(51) Int. Cl.
*B65B 31/04* (2006.01)

(52) U.S. Cl. ..... 141/65; 141/114; 141/374

(58) Field of Classification Search ..... 141/65, 141/114, 323, 374, 382; 222/105, 464.2
See application file for complete search history.

(56) References Cited

U.S. PATENT DOCUMENTS

| | | | | |
|---|---|---|---|---|
| 4,138,036 | A | 2/1979 | Bond | |
| 4,286,636 | A * | 9/1981 | Credle | 141/114 |
| 4,421,146 | A | 12/1983 | Bond et al. | |
| 5,156,300 | A * | 10/1992 | Spahni et al. | 222/105 |
| 5,647,511 | A | 7/1997 | Bond | |
| 4,421,146 | A | 2/1998 | Bond et al. | |
| 6,347,785 | B1 | 2/2002 | Copp et al. | |
| 2002/0179875 | A1 | 12/2002 | Davis et al. | |

FOREIGN PATENT DOCUMENTS

EP 0367937 A1 5/1990

* cited by examiner

*Primary Examiner*—Timothy L. Maust
(74) *Attorney, Agent, or Firm*—Potter Anderson & Corroon LLP

(57) ABSTRACT

The present invention provides a flexible mounting for securing at least one evacuation member to a fitment for use in a collapsible bag. The mounting comprises a peripheral ring adapted to fit within a spout of the fitment, a central member to which the at least one evacuation member is secured and a plurality of spring members extending between the peripheral ring and the central member, the spring members supporting the central member while permitting the central member to be displaced relative to the peripheral ring.

8 Claims, 4 Drawing Sheets

FLEXIBLE MOUNTING FOR EVACUATION CHANNEL

This application claims the benefit of U.S. Provisional Application No. 60/386,749 filed Jun. 10, 2002, which is incorporated by reference herein in its entirety.

FIELD OF THE INVENTION

The present invention relates to a mounting for connecting an evacuation channel to the spout of a flexible bag and more particularly to a flexible mounting for connecting such an evacuation channel.

BRIEF DESCRIPTION OF THE PRIOR ART

Flexible plastic bags have come to be widely used to distribute and dispense liquids such as wine and syrups for preparing drinks. Such bags typically have a thin, flexible plastic wall having a dispensing spout or fitment sealed to the wall of the bag. In use the flexible bag is filled with a flowable material to be dispensed, and the bag is packed in a relatively rigid container, e.g., a corrugated cardboard box, for distribution. At the point of use, the spout is extended through a hole in the side of the rigid container and a dispensing tap or service line connector is fitted thereto to control and direct the dispensing of the contents of the bag. Because the walls of the bag are thin and very flexible, the bag collapses as the contents are removed. As the liquid contents of the bag are dispensed, it is possible that one of the flexible bag walls may be drawn close to the spout, even when a substantial proportion of the contents remain in the bag, and may come to cover the inner end of the spout, thus blocking it and shutting off flow. Because of the pressure of the remaining liquid in the bag on the wall, it is difficult and troublesome to dislodge the wall from the spout and remove the blockage.

Accordingly, it has become customary to provide an evacuation channel or form within the flexible bag to prevent the thin wall from blocking the spout as the bag is emptied. One such example of an evacuation channel is disclosed in U.S. Pat. No. 4,138,036, to Curtis J. Bond, the entire disclosure of which is incorporated herein by reference. The Bond patent discloses a helical channel or tube that is mounted in the spout and extends into the interior of the flexible bag. As described therein, the bag collapses around the evacuation channel. Accordingly, the wall of the bag cannot block the spout. Furthermore the evacuation channel provides a path for the contents to reach the spout even when the walls of the bag have collapsed around it, thereby assuring substantially complete drainage of the contents of the bag.

However, although the helical evacuation channel disclosed in the Bond patent is very effective, it is not well adapted to the more modern practice of forming flexible bags from a pair of walls made from a flexible plastic film and sealed together around their edges. Such bags are convenient because they are relatively flat in the unfilled condition, and, accordingly, are convenient to store and to ship to a location where they are to be filled. Because of the way in which the evacuation channel of the Bond patent is mounted, it extends some distance into the bag from the inner end of the spout. This prevents the bag from assuming the desirable flattened configuration. Furthermore, because of the mounting of the helical channel of the Bond patent, it is inserted into the bag after it is formed, which necessitates an extra manufacturing step.

Furthermore, the mounting of the helical channel disclosed in the Bond patent is not well adapted to use with collapsible bags for use with service line connectors that are provided with quick-disconnect fittings and valves. Such quick-disconnect fittings and valves may use a valve element that slides within the fitment or spout, projecting into the bag when actuated by the insertion of a service line connector and being withdrawn within the fitment to cut off the flow of contents when the connector is withdrawn. Because of possible interference between the slider of such a valve and an evacuation channel attached to the spout it has not been possible to mount an evacuation channel, and particularly a desirable helical evacuation channel, to the center of the spout as with the mounting arrangement of the Bond patent.

Accordingly, a need has continued to exist for a mounting for an evacuation member or channel of helical or other shape that will permit the channel to lie as flat as possible within the newly-manufactured flexible bag and also permit the evacuation channel to be mounted generally in the center of the spout. Further the flexible mounting allows the evacuation member to operate without any interference from any service line connector that the fitment may be connected to.

SUMMARY OF THE INVENTION

This need has now been addressed by the mounting of the present invention. The present invention provides a flexible mounting for securing an evacuation member to a fitment for use in a collapsible bag. The flexible mounting comprises a peripheral ring adapted to fit within a spout of the fitment, a central member to which the evacuation member is secured and a plurality of spring members extending between the peripheral ring and the central member. The spring members support the central member while permitting the central member to be displaced relative to the peripheral ring.

According to the invention a mounting for an evacuation channel comprises a retaining ring sized to fit snugly at the inner end of a spout of a collapsible bag, a central mounting disk having a diameter smaller than the inner diameter of the retaining ring, and a plurality of flexible members extending in a tortuous path from the inner edge of the retaining ring to the outer periphery of the Amounting disk.

The present invention further provides a mounting means for attaching an evacuation channel to the spout of a collapsible bag.

The present invention further provides a flexible mounting for attaching an evacuation channel to the spout of a collapsible bag.

The present invention further provides an evacuation channel having an open helical wall flexibly mounted to the spout of a collapsible bag.

The present invention further provides a flexible mounting for an evacuation channel that can be employed with a plurality of different service line connectors.

The present invention further provides a flexible mounting for an evacuation channel that can be installed in a spout of a collapsible bag before the bag is formed by peripheral sealing of opposed walls or panels.

The present invention further provides a flexible mounting for fastening an evacuation channel to the spout of a collapsible bag without using a heat sealing step.

Finally the flexible mounting of the invention ensures that the bag does not collapse about the spout such that evacuation is blocked.

Further aspects of the invention will become apparent from the description of the invention which follows.

DETAILED DESCRIPTION OF THE INVENTION AND PREFERRED EMBODIMENTS

The present invention provides a flexible mounting for securing an evacuation member to a fitment for use in a collapsible bag. The flexible mounting comprises a peripheral ring adapted to fit within a spout of the fitment, a central member to which the evacuation member is secured and a plurality of spring members extending between the peripheral ring and the central member. The spring members supporting the central member while permitting the central member to be displaced relative to the peripheral ring.

The advantages of an evacuation member or channel in a collapsible bag are achieved according to the invention by using a flexible mounting fitted to the inner end of the spout or fitment of the bag. Such a flexible mounting allows the helical channel to lie within the flat collapsed bag as manufactured and then to swing into the liquid contents of the bag after it is filled, with the evacuation channel extending generally from the center of the spout. The advantages, operation, and construction of a helical channel are disclosed in U.S. Pat. No. 4,134,036, the entire disclosure of which is incorporated herein by reference.

The flexibly mounted helical evacuation channel can also be used with fitments that incorporate a slide valve extending into the bag in its open position. Accordingly, the flexible mounting of the invention permits a single type of collapsible bag fitted with an evacuation channel to be used with several different types of service line connectors. Different types of service line connectors and their use with a single type of fitment and valve are disclosed in U.S. Pat. No. 6,347,785, to Copp et al., the entire disclosure of which is incorporated herein by reference. A slide valve suitable for use with different types of service line connectors, some requiring a poppet valve and others a slide valve, is disclosed in Applicant's co-pending U.S. patent application Ser. No. 10/076,572, filed Feb. 19, 2002, the entire disclosure of which is incorporated herein by reference.

A preferred embodiment of the invention will be described with reference to the figures of the accompanying drawings.

Figure 1:
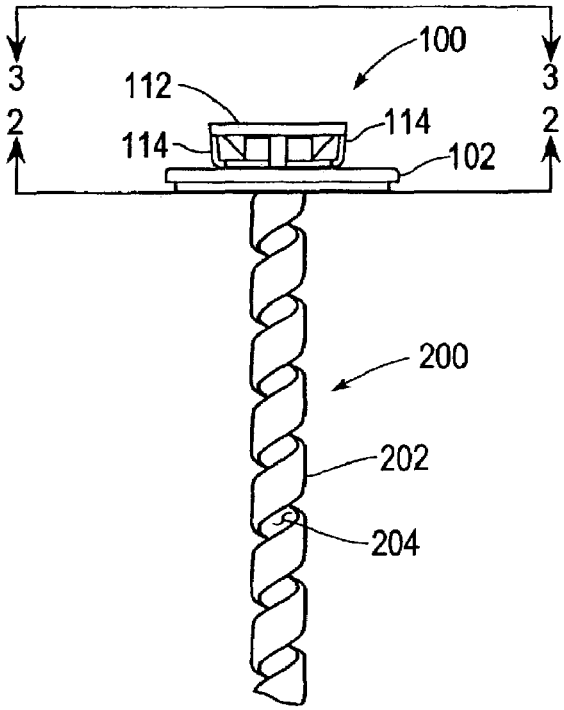
FIG. 1 illustrates a side elevational view of the flexible mount of the invention in its collapsed state with a helical evacuation channel attached thereto.
Figure 2:
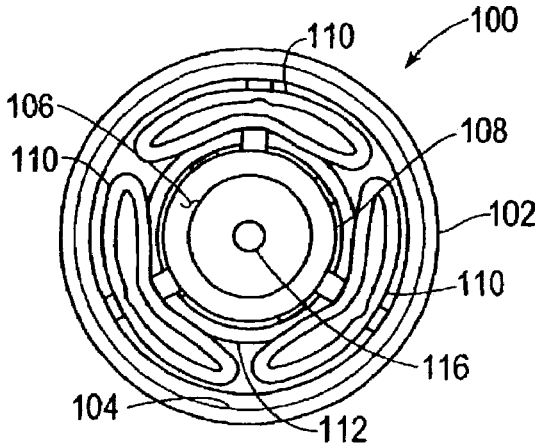
FIG. 2 is an elevational view of the mounting in the direction indicated by the arrows 2—2 in FIG. 1.
Figure 3:
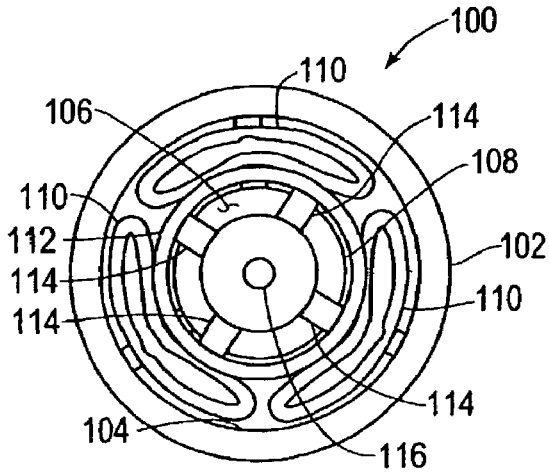
FIG. 3 is an elevational view of the mounting in the direction indicated by the arrows 3—3 in FIG. 1.

FIG. 1 shows a side elevational view of a flexible mounting generally indicated at 100 and an attached helical evacuation member generally indicated at 200. The mounting 100, as shown in FIGS. 2 and 3, comprises an outer or peripheral ring 102, a central member 106 and a plurality of, in this example three, flexible spring members 110 extending between inner rim 104 of the peripheral ring 102 and outer rim 108 of the central member 106. The spring members 110 follow a tortuous or curved path between the peripheral ring 102 and the central member 106 in order to provide the required flexibility of movement for the central member 106.

A contact ring 112 is supported by, in this case four, evenly spaced supports 114 extending outwardly and upwardly from the periphery of the central member 106. The contact ring 112 and supports 114 provide mechanical strength and stiffness to the central disk 106, and the contact ring 112 makes contact with a slider 400 (see FIGS. 6 and 7) of a fitment to transmit the force of the slider 400 to the central disk 106. Although the contact ring 112 and supports 114 are used in the illustrated preferred embodiment of the invention, they are not essential thereto. Furthermore, although the central member 106 is shown in its preferred disk-like circular shape in the illustrated embodiment, it may be of any suitable shape, such as square, hexagonal, or the like as would be apparent to a person skilled in the art.

Figure 4:
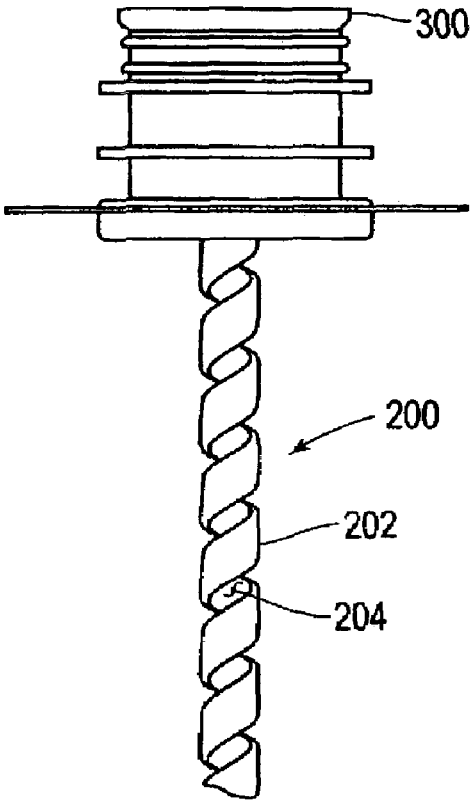
FIG. 4 is a side elevational view of a fitment containing the flexible mount of the invention in its collapsed state with a helical evacuation channel attached thereto.

FIG. 4 shows a side elevational view of a conventional fitment with the flexible mounting 100 and the evacuation member 200 inserted therein. In the embodiment shown the evacuation member 200 is a helical channel, however, it will be understood by a person skilled in the art that the evacuation member 200 may comprise any form that provides a channel for evacuation of the bag. For example, the evacuation member 200 may comprise an elongated tube comprising a plurality of apertures or may comprise tubular netting, such as Vexar®. Other suitable configurations would be apparent to the person skilled in the art as long as they provide the required evacuation result. Further the flexible mounting 100 may have more than one evacuation member 200 attached thereto, for example the evacuation member may comprise a plurality of elongated members that extend outwardly from the mounting 100 when the evacuation member 200 is attached thereto providing at least one channel therebetween for evacuation of the bag.

The evacuation member 200 comprises a helical wall 202 surrounding a central channel 204. The helical wall 202 is effective in keeping the walls of a collapsible bag from intruding into the central channel 204. Accordingly, an open channel is maintained through which the contents of the collapsible bag can flow to the spout as the walls of the bag collapse.

Figure 5:
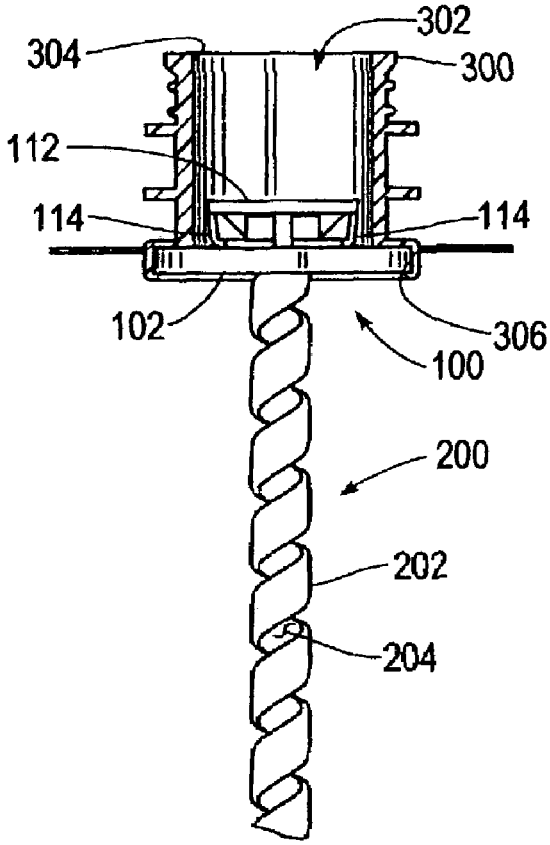
FIG. 5 is a side elevational view of the fitment and mounted helical channel of FIG. 4 with the fitment shown in cross section.

FIG. 5 shows a side elevational view of the fitment and channel of FIG. 4 with the fitment 300 cut away to show the evacuation member 200 and mounting 100 in position. The mounting 100 is positioned at the end of the spout 302 of the fitment 300, adjacent the collapsible bag. The peripheral ring 102 of the flexible mounting 100 is retained in an annular groove 306 formed in the inner wall 304 of the fitment 300.

The mounting 100 may be retained in the fitment by any conventional means. In the illustrated embodiment the mounting 100 is retained in the fitment 300 by an interference fit between the peripheral ring 102 of the mounting 100 and the annular groove 306 of the fitment 300. However the mounting 100 can also be retained in the fitment by a frictional fit, adhesive bonding, thermal welding, or the like.

Figure 6:
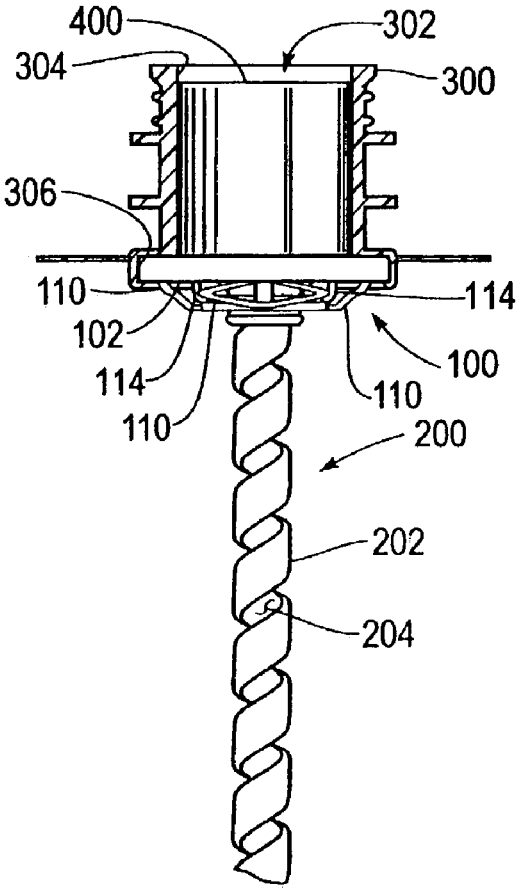
FIG. 6 is a side elevational view of the fitment and mounted helical channel of FIG. 5 with the mounting shown partially extended when used with a slider that does not extend into the interior of the collapsible bag.

FIG. 6 shows the position of the evacuation member 200 and mounting 100 after the bag has been filled and is capped with a cap (not shown) for shipping the filled bag. Although the helical channel is shown extending straight along the axis of the fitment 300, it will be understood that the evacuation member 200 is flexible and may bend to assume any position within the filled bag both when the bag is being shipped and as the contents of the bag are withdrawn at the point of use. When the filled bag is used with a service line connector that does not require the slider 400 to be depressed into the container, i.e., a connector that opens a poppet valve at the inward end of the slider, as shown, for example, in U.S. Pat. No. 6,347,785, the slider remains in the position illustrated in FIG. 6. The fluid material in the bag then flows through the open areas between the spring members 110 and through the central hole 116 of the central member 106 and thence out through the open poppet valve of the slider 400.

Figure 7:
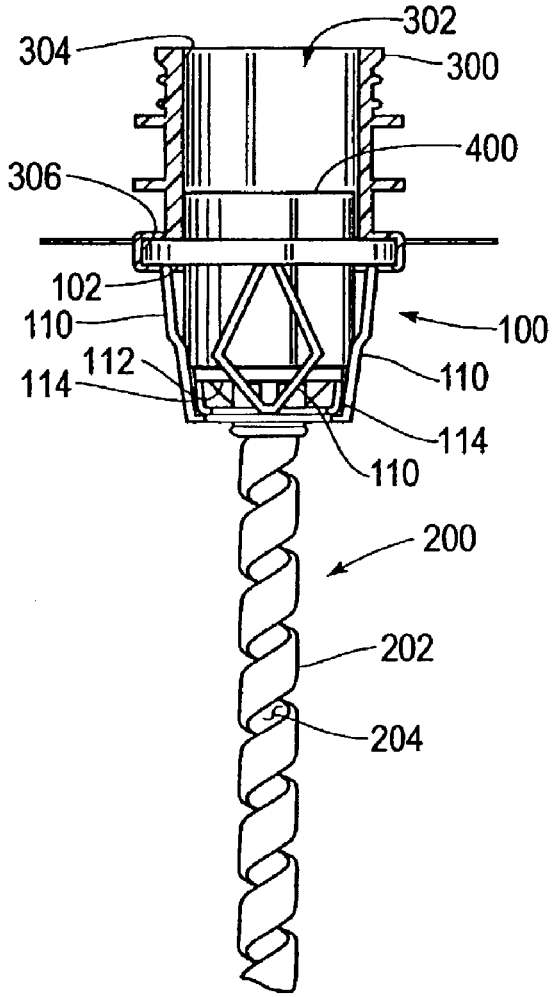
FIG. 7 is a side elevational view of the fitment and mounted helical channel of FIG. 5 with the mounting shown fully extended when used with a slider that extends into the interior of the collapsible bag.

FIG. 7 shows the position assumed by the central member 106 when the mounting 100 is used with a service line connector that requires the slider 400 to be depressed into the interior of the bag. Such connectors typically are used with sliders that have laterally facing holes through which the contents of the bag flow when the slider is depressed to its open position. A connector of this type is disclosed in U.S. Pat. No. 4,421,146, to Bond, the entire disclosure of which is incorporated herein by reference. Such sliders may also be equipped, at the inward end, with a poppet valve which is opened by the service line connector. When such a service line connector is used, the central member 106 is moved into the bag by the slider 400 and is guided and supported in its extended position by the spring members 110. The action of the spring members 110 is shown in this figure. The fluid material in the bag then flows through the open areas between the spring members 110 and through the central hole 116 of the central member 106 and thence out through any lateral holes in the slider 400 and an open poppet valve (if present) of the slider 400. When the service line connector is withdrawn with the bag partially full, the slider 400 is retracted to its position as shown in FIG. 6 and the central disk 106 of the flexible mounting 100 returns to its initial position as shown in FIG. 6.

Figure 8:
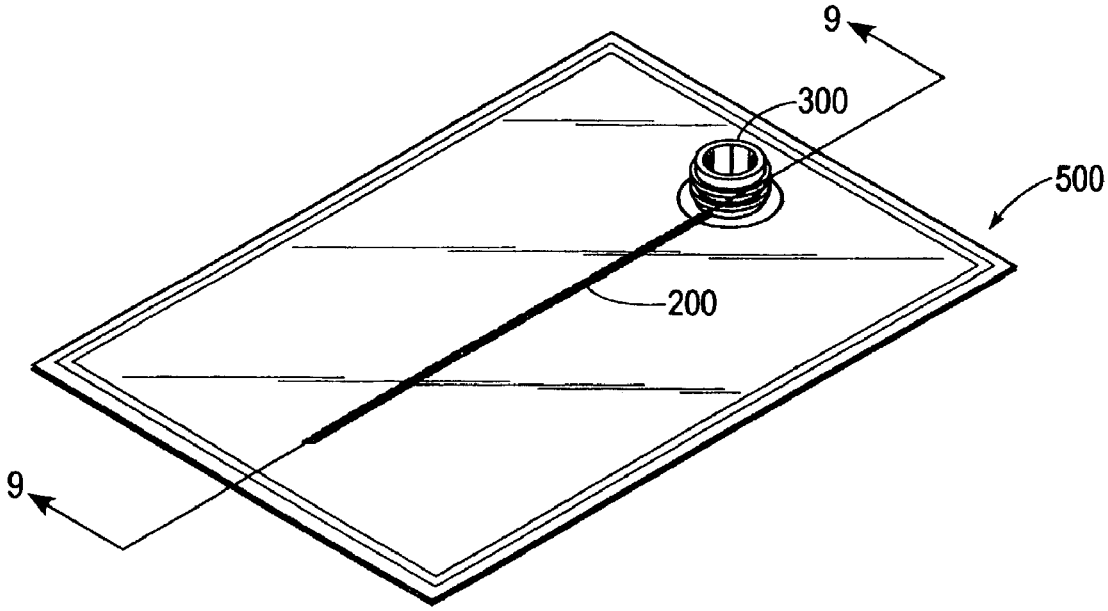
FIG. 8 is an isometric overall view of a collapsible bag before filling with liquid containing a helical evacuation channel attached to the spout by a flexible mounting of the invention.
Figure 9:
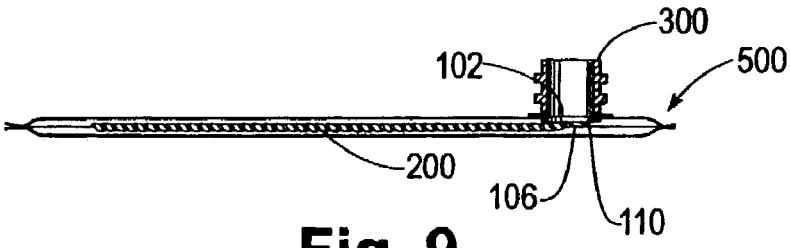
FIG. 9 is a side elevational cross-sectional view of the bag of FIG. 8 taken along the line 9—9 in FIG. 8.

FIG. 8 shows a view of a conventional collapsible bag 500 having a fitment 300 as manufactured before being filled with liquid contents, showing the evacuation member 200 positioned within the bag. FIG. 9 is a side elevational cross-sectional view of the bag of FIG. 8 taken along the line 9—9 in FIG. 8.

FIG. 9 shows the evacuation member 200 attached to the inner end of the spout by means of mounting 100 and extending generally perpendicularly to the axis of the spout between the walls of the collapsed bag. The flexibility of the evacuation member 200 and the capability of the central member 104 to be somewhat twisted from its rest position as shown permit the helical channel to lie within the flattened bag to minimize the thickness of the bag as manufactured and shipped to the location at which it is filled.

Although the flexible mount of the invention can be assembled from separate parts such as a peripheral ring, central disk, and spring members, it is preferably made by molding from any suitable synthetic resin having sufficient flexibility. Typical materials are polyethylene, polypropylene and the like. A preferred material is polyethylene. Furthermore, although the helical channel may be manufactured separately and welded or heat-sealed to the central disk, it is also according to the invention to form the helical channel integrally with the flexible mount, as by for example, molding.

All preferences expressed herein may be combined in any desired and suitable manner to create additional preferred combinations or embodiments of the invention and such combinations are all within the scope of the invention disclosed herein.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than by the foregoing description, and all changes which come within the meaning and range of equivalency of the claims are intended to be embraced therein.

We claim:

1. A flexible mounting for securing at least one evacuation member to a fitment for use in a collapsible bag the mounting comprising:

a peripheral ring adapted to fit within a spout of the fitment;

a central member to which the at least one evacuation member is secured; and a plurality of spring members extending between said peripheral ring and said central member, said spring members supporting said central member while permitting said central member to be displaced relative to said peripheral ring;

wherein the plurality of spring members permits the displacement of the central member relative to said peripheral ring to allow accomodation of any service line connector to which the fitment is secured without interfering with the operation of the at least one evacuation member and the at least one evacuation member can be as flat as possible within the bag upon manufacture.

2. A flexible mounting according to claim 1, wherein the at least one evacuation member provides at least one channel for evacuation of the bag.

3. A flexible mounting according to claim 1, wherein the at least one evacuation member is integrally formed with the flexible mounting.

4. A flexible mounting according to claim 1, wherein the at least one evacuation member is a helical coil.

5. A flexible mounting according to claim 1, wherein the at least one evacuation member is made from tubular netting.

6. A flexible mounting according to claim 1, wherein the at least one evacuation member comprises a tubular attachment portion located at one end thereof for snap fit connection to the central member.

7. A flexible mounting for attachment to a fitment for use in a collapsible bag the mounting comprising:

a peripheral ring and a central member, the peripheral ring adapted to fit within a spout of the fitment;

a plurality of spring members extending between said peripheral ring and said central member, said spring members supporting said central member while permitting said central member to be displaced relative to said peripheral ring; and an evacuation member, for providing at least one channel for evacuation of the bag, secured to said central member of said mounting;

wherein the plurality of spring members permits the displacement of the central member relative to said peripheral ring to allow accommodation of any service line connector to which the fitment is secured without interfering with the operation of the at least one evacuation member and the at least one evacuation member can be as flat as possible within the bag upon manufacture.

8. A fitment for use in a collapsible bag comprising:

a mounting having a peripheral ring adapted to fit within a spout of the fitment, a central member and a plurality of spring members extending between said peripheral ring and said central member, said spring members supporting said central member while permitting said central member to be displaced relative to said peripheral ring; and at least one evacuation member, for providing at least one channel for evacuation of the bag, secured to said central member of said mounting;

wherein the plurality of spring members permits the displacement of the central member relative to said peripheral ring to allow accommodation of any service line connector to which the fitment is secured without interfering with the operation of the at least one evacuation member and the at least one evacuation member can be as flat as possible within the bag upon manufacture.

* * * * *